US011090937B2

(12) United States Patent
Nakagawa et al.

(10) Patent No.: US 11,090,937 B2
(45) Date of Patent: Aug. 17, 2021

(54) LIQUID EJECTION HEAD, LIQUID EJECTION APPARATUS, AND LIQUID SUPPLY METHOD

(71) Applicant: CANON KABUSHIKI KAISHA, Tokyo (JP)

(72) Inventors: Yoshiyuki Nakagawa, Kawasaki (JP); Kazuhiro Yamada, Yokohama (JP); Takuro Yamazaki, Nagi (JP); Toru Nakakubo, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/682,120

(22) Filed: Nov. 13, 2019

(65) Prior Publication Data

US 2020/0207086 A1 Jul. 2, 2020

(30) Foreign Application Priority Data

Dec. 26, 2018 (JP) ..... JP2018-242989

(51) Int. Cl.
*B41J 2/14* (2006.01)
*B41J 2/145* (2006.01)

(52) U.S. Cl.
CPC ..... *B41J 2/145* (2013.01); *B41J 2/1404* (2013.01); *B41J 2/1433* (2013.01); *B41J 2202/12* (2013.01)

(58) Field of Classification Search
CPC .... B41J 2/0458; B41J 2/14032; B41J 2/1404; B41J 2/1433; B41J 2/145; B41J 2/18; B41J 2202/12
See application file for complete search history.

(56) References Cited

U.S. PATENT DOCUMENTS 6,244,694 B1 * 6/2001 Weber ..... B41J 2/055 347/65
9,211,721 B2 * 12/2015 Govyadinov ..... B41J 2/175
2007/0291082 A1 * 12/2007 Baumer ..... B41J 2/04 347/68
2013/0057622 A1 * 3/2013 Govyadinov ..... B41J 2/1404 347/85

FOREIGN PATENT DOCUMENTS

WO 2011/146069 A1 11/2011

* cited by examiner

*Primary Examiner* — Anh T Vo
(74) *Attorney, Agent, or Firm* — Venable LLP

(57) ABSTRACT

In a liquid ejection head, ejection orifices can be densely arranged while suppressing decrease in liquid flow speed. A channel extending through a pressure chamber extends in a direction crossing an ejection orifice array such that a liquid flows between the two ends of the channel located on the sides of the ejection orifice array.

12 Claims, 8 Drawing Sheets

LIQUID EJECTION HEAD, LIQUID EJECTION APPARATUS, AND LIQUID SUPPLY METHOD

BACKGROUND OF THE DISCLOSURE

Field of the Disclosure

The present disclosure relates to a liquid ejection head, a liquid ejection apparatus, and a liquid supply method capable of ejecting a liquid such as ink.

Description of the Related Art

In inkjet print heads for example, which eject liquid ink, as liquid ejection heads, a volatile component in the ink may possibly evaporate from the ejection orifices from which to eject the ink and thereby thicken the ink in the ejection orifices. Such thickening of the ink changes the ink ejection speed and so on and may cause ejection failures including a deterioration in ink landing accuracy. In particular, in a case where no ink ejection operation has been performed for a prolonged period of time, the increase in ink viscosity is so significant that solid components in the ink fixedly attach to the inside of the ejection orifices. This increases the ink flow resistance and accordingly increases the likelihood of ink ejection failures.

International Publication No. WO 2011/146069 discloses a configuration in which each ejection orifice communicates with a U-shaped circulation channel through which ink is circulated, and the ink flow is caused to enter the ejection orifice to make it more difficult for the ink in the ejection orifice to thicken.

SUMMARY OF THE DISCLOSURE

In the first aspect of the present disclosure, there is provided a liquid ejection head comprising:

a plurality of ejection orifices forming an ejection orifice array;

a plurality of pressure chambers corresponding to the plurality of ejection orifices;

a plurality of ejection energy generation elements configured to eject a liquid in the plurality of pressure chambers from the plurality of ejection orifices corresponding to the plurality of pressure chambers;

a plurality of channels in which the liquid is caused to flow through the plurality of pressure chambers; and a plurality of flow energy generation elements configured to cause the liquid in the plurality of channels to flow, wherein at least one of the plurality of channels extends in a direction crossing the ejection orifice array such that the liquid flows between two ends of the channel located on sides of the ejection orifice array.

In the second aspect of the present disclosure, there is provided a liquid ejection apparatus comprising:

a plurality of ejection orifices forming an ejection orifice array, a plurality of pressure chambers corresponding to the plurality of ejection orifices, a plurality of ejection energy generation elements configured to eject a liquid in the plurality of pressure chambers from the plurality of ejection orifices corresponding to the plurality of pressure chambers, a plurality of channels in which the liquid is caused to flow through the plurality of pressure chambers, and a plurality of flow energy generation elements configured to cause the liquid in the plurality of channels to flow, at least one of the plurality of channels extending in a direction crossing the ejection orifice array such that the liquid flows between two ends of the channel located on sides of the ejection orifice array;

a supply unit configured to supply the liquid into the channels of the liquid ejection head; and a control unit configured to control the ejection energy generation elements and the flow energy generation elements.

In the third aspect of the present disclosure, there is provided a liquid supply method of supplying a liquid to a liquid ejection head from which the liquid in a plurality of pressure chambers corresponding to a plurality of ejection orifices forming an ejection orifice array is ejected from the plurality of ejection orifices by a plurality of ejection energy generation elements and in which the liquid is caused to flow in a plurality of channels extending through the plurality of pressure chambers by a plurality of flow energy generation elements, and at least one of the plurality of channels extends in a direction crossing the ejection orifice array such that the liquid flows between two ends of the channel located on sides of the ejection orifice array, the liquid supply method comprising supplying the liquid through the at least one channel to the pressure chamber through which the channel extends.

Further features of the present disclosure will become apparent from the following description of exemplary embodiments with reference to the attached drawings.

DESCRIPTION OF THE EMBODIMENTS

Here, in the configuration disclosed in International Publication No. WO 2011/146069, in a case where the plurality of ejection orifices form an ejection orifice array, the two straight portions of each U-shaped circulation channel are located on the ejection orifice array. In order to densely arrange a plurality of ejection orifices as an ejection orifice array, each U-shaped circulation channel must be narrow, which accordingly increases the ink flow resistance and thus lowers the speed of the ink circulatory flow. Also, in a case where such a U-shaped circulation channel is equipped with a flow energy generation element that causes the ink to flow, the size of the flow energy generation element must be reduced as well, which further lowers the speed of the ink circulatory flow. In the case where the speed of the ink circulatory flow is lowered, thickened ink remains in the ejection orifice. Thus, ink ejection failures are more likely to occur.

The present disclosure provides a liquid ejection head, a liquid ejection apparatus, and a liquid supply method in which ejection orifices can be densely arranged while decrease in liquid flow speed is suppressed.

Embodiments of the present disclosure will be described below with reference to the drawings.

First Embodiment

Figure 1A:
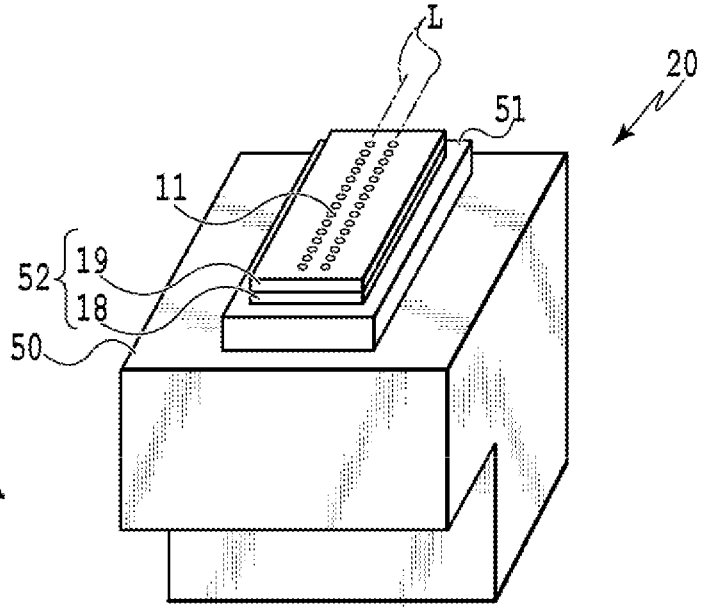
FIGS. 1A to 1C are explanatory diagrams of a liquid ejection head in a first embodiment of the present disclosure.
Figure 1B:
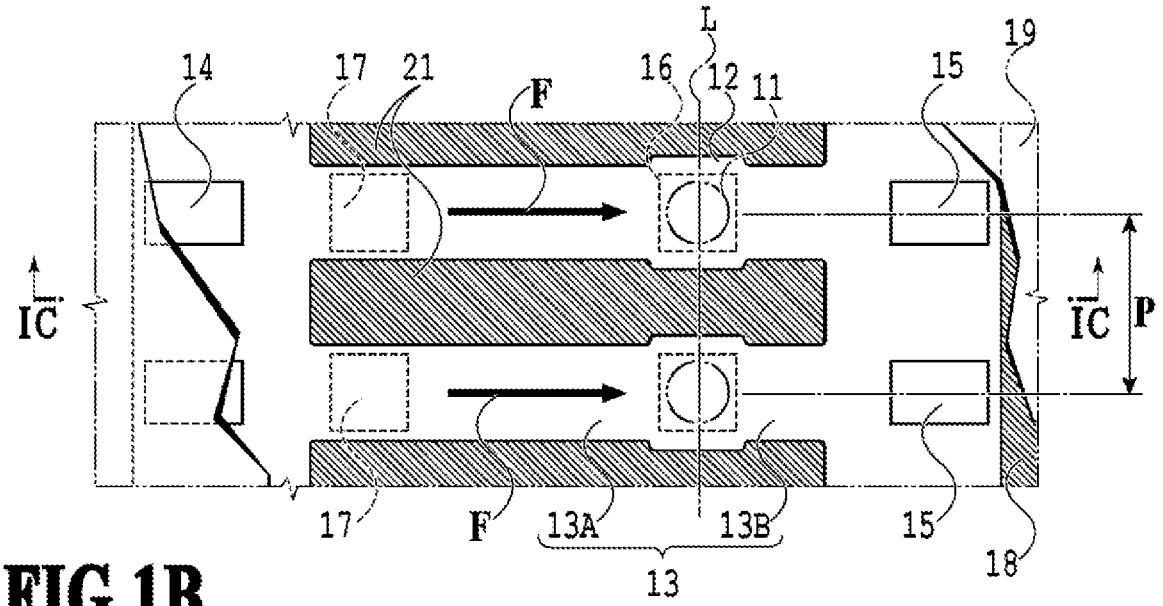
Figure 1C:
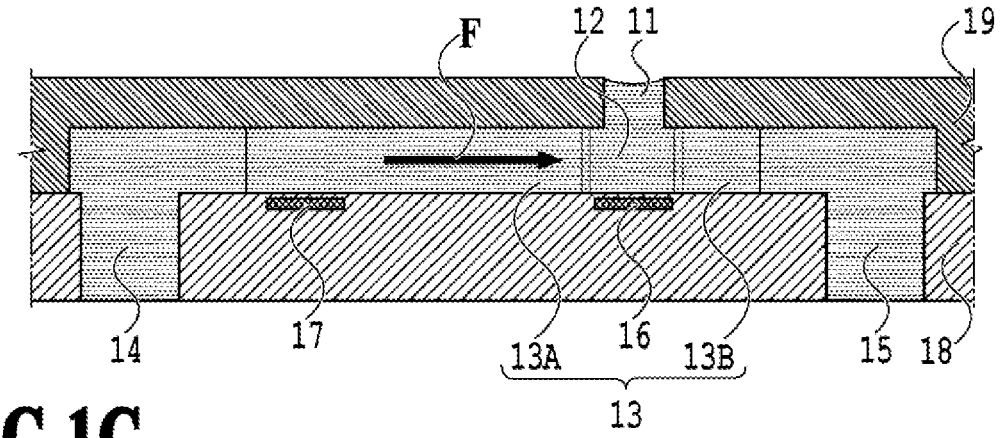

FIG. 1A is a schematic perspective view for explaining a (inkjet) print head 20 that ejects ink (liquid) as a liquid ejection head in a first embodiment of the present disclosure. A connecting member 51 and a printing element board 52 are provided on a head main body 50. An orifice plate 19 in which a plurality of ejection orifices 11 are formed is provided on a substrate 18 of the printing element board 52. The plurality of ejection orifices 11 are arrayed at a predetermined pitch so as to form two ejection orifice arrays L. The number of ejection orifice arrays L is not limited to two. FIG. 1B is an enlarged plan view of the printing element board 52 with the orifice plate 19 partly cut out, and FIG. 1C is a cross-sectional view along line IC-IC in FIG. 1B.

Between the substrate 18 and the orifice plate 19, there are formed: pressure chambers 12 which are separated from each other by partitions 21 and each of which corresponds to one of the ejection orifices 11; and channels 13 in which ink is caused to flow through these pressure chambers 12. Each channel 13 extends in a direction crossing (perpendicularly in the present embodiment) the ejection orifice array L, and includes a first channel 13A on the left side in FIG. 1C communicating with one end of the pressure chamber 12 and a second channel 13B on the right side in FIG. 1C communicating with the opposite end of the pressure chamber 12. The first channel 13A communicates with a supply channel 14 penetrating through the substrate 18, while the second channel 13B communicates with an outlet channel 15 penetrating through the substrate 18. Thus, the first channel 13A, communicating with the supply channel 14, is located on the left side in FIG. 1B relative to the ejection orifice array L, while the second channel 13B, communicating with the outlet channel 15, is located on the right side in FIG. 1B relative to the ejection orifice array L. The two ends of the channel 13 are located on mutually opposite sides of the ejection orifice array L.

Ink is externally supplied to the first channel 13A through the supply channel 14, and ink in the second channel 13B is caused to flow out through the outlet channel 15. In the present embodiment, the ink caused to flow out from the outlet channel 15 is returned to the supply channel 14 to be circulated, so that an ink circulatory flow as shown by arrow F is formed through the channel 13. Note that the configuration may be either such that the supply channels 14 and the outlet channels 15 are individually connected to respective channels and formed as common channels outside the print head or such that the supply channels 14 and the outlet channels 15 are formed as common channels inside the chip (not shown).

In each ink circulation channel inside and outside the print head 20, a filter may be provided which removes foreign matters including bubbles and so on in the ink. In each ejection orifice 11, a meniscus is formed as the interface between the ink and the atmosphere.

In the substrate 18, electrothermal conversion elements (ejection heaters) 16 are provided as ejection energy generation elements (pressure generation elements) that generate energy for ejecting the ink in the respective pressure chambers. Each ejection heater 16 is present along with the ejection orifice 11 and the pressure chamber 12 and located closer to the outlet channel 15 than to the supply channel 14. With the ejection heater 16 driven to generate heat and thus forming a bubble in the ink in the pressure chamber 12, the ink is ejected from the ejection orifice 11 with the bubble forming energy. The ejection energy generation element is not limited to the heater 16 as in the present embodiment, but a piezoelectric element or the like can be used. Moreover, in the substrate 18, electrothermal conversion elements (circulation heaters) 17 are provided as flow energy generation elements (pressure generation elements) that generate energy for causing the ink in the respective channels to flow in the direction of arrows F. Each circulation heater 17 is located closer to the supply channel 14 than to the outlet channel 15. Note that a heater as in the present embodiment is preferably used as the flow energy generation element, but a piezoelectric element, a micropump using electrodes, or the like may be used instead.

Figure 2A:
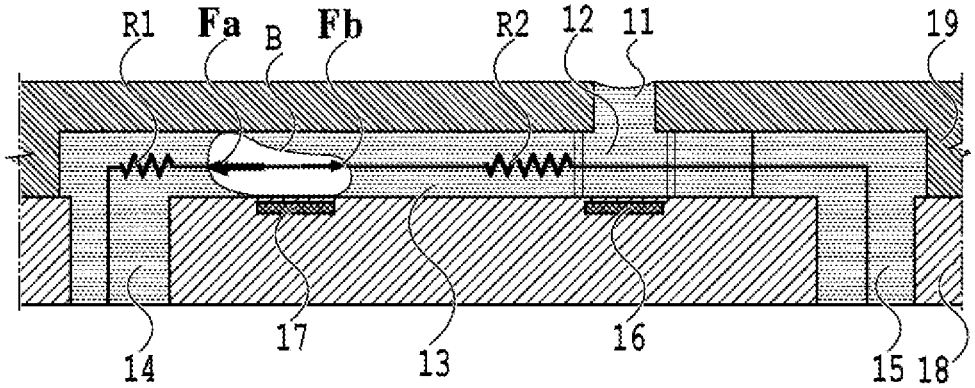
FIGS. 2A to 2C are explanatory diagrams of the principle of generation of an ink circulatory flow in the liquid ejection head in FIGS. 1A to 1C.
Figure 2B:
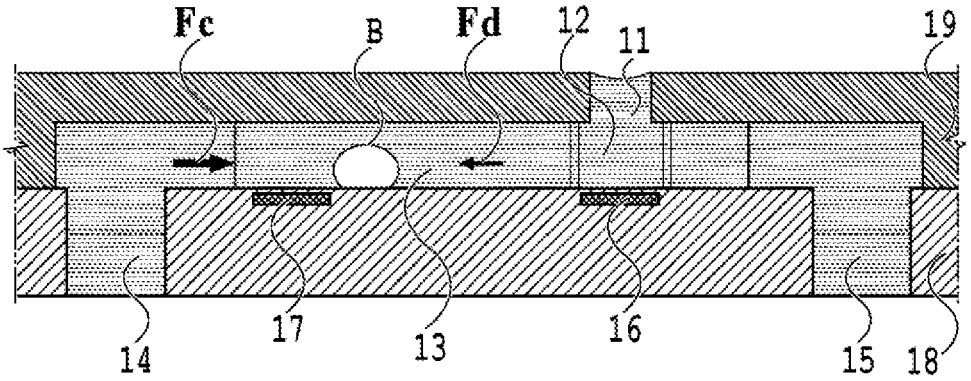
Figure 2C:
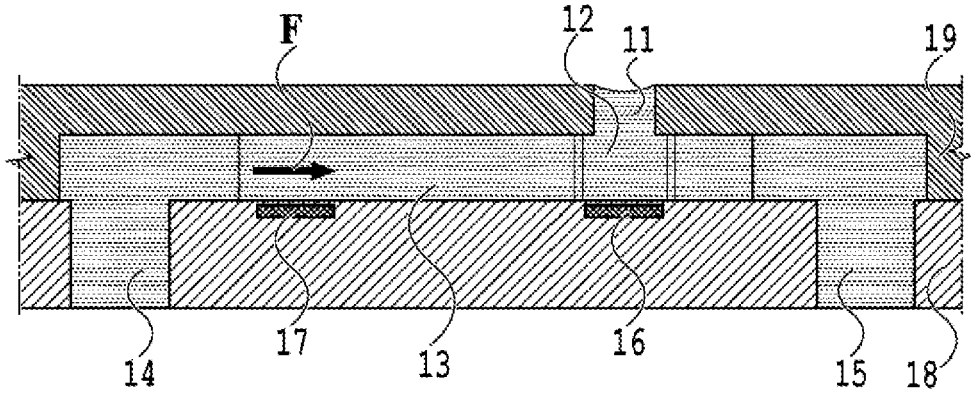

FIGS. 2A to 2C are diagrams for explaining the principle of generation of the ink circulatory flow by each circulation heater 17. FIG. 2A is a cross-sectional view, similar to FIG. 1C, in a state where a bubble B is grown by film boiling of ink as a result of heating the ink with the circulation heater 17. Since the circulation heater 17 is located closer to the supply channel 14 than to the outlet channel 15, a flow resistance R1 (first flow resistance) between the circulation heater 17 and the supply channel 14 is smaller than a flow resistance R2 (second flow resistance) between the circulation heater 17 and the outlet channel 15. In FIG. 2A, equivalent circuits representing these flow resistances R1 and R2 as electrical resistances are combined. As shown in FIG. 2A, due to the difference between the flow resistances R1 and R2, the bubble B generated by the film boiling of the ink grows unevenly toward the supply channel 14 side with the smaller flow resistance R1. Accordingly, in the channel 13, an ink flow Fa toward the supply channel 14 is greater than an ink flow Fb toward the outlet channel 15.

FIGS. 2B and 2C are explanatory diagrams of the ink flow in the course of shrinkage of the bubble B. In the course of shrinkage of the bubble B, ink flows in so as to compensate for the volume of the shrinkage. At this moment, as shown in FIG. 2B, an ink flow Fc coming from the supply channel 14 side with the smaller flow resistance R1 is greater than an ink flow Fd coming from the outlet channel 15 side with the larger flow resistance R2. Thus, the position at which the bubble B disappears is offset toward the outlet channel 15 from above the circulation heater 17. Consequently, as shown in FIG. 2C, an ink circulatory flow F moving from the supply channel 14 toward the outlet channel 15 is generated.

Due to evaporation of a volatile component in ink from the ejection orifice 11, the ink gets concentrated and thus thickened. However, the ink circulatory flow F makes it difficult for the thickened ink to remain in the ejection orifice 11. Specifically, with part of the ink circulatory flow F entering the ejection orifice 11, the thickened ink in the ejection orifice 11 is forced into the second channel 13B and fresh ink is caused to flow into the ejection orifice 11 from the first channel 13A. By thus making it difficult for the thickened ink to remain in the ejection orifice 11, the effect of the thickened ink is suppressed and thus the desired ink ejection condition is maintained.

The ratio between the flow resistances R1 and R2 and the size of the bubble B affect the size of the circulatory flow F. For example, under the assumption that the circulation heater 17, i.e., flow energy generation element, is an electrothermal conversion element, the flow resistance ratio R1/R2 is preferably set in the range of from 0.05 to 0.40. Setting the flow resistance ratio R1/R2 in this range enables the speed of the circulatory flow F to be high. Also, the larger the bubble B, the higher the speed of the circulatory flow F. For the speed of the circulatory flow F to be high, it is important to generate a large bubble B by making the size of the circulation heater 17 large and to make the flow resistance in the channel 13 low. However, densely arranging the circulation heaters 17 inevitably makes each circulation heater 17 small in size, which lowers the speed of the circulatory flow F. Meanwhile, under the assumption that each circulation heater 17, i.e., flow energy generation element, is an electrothermal conversion element, the flow energy generation element is preferably located closer to one of the two ends of the channel 13 than the ejection energy generation element is in order to generate a good circulatory flow F.

The circulatory flow F attenuates with the elapse of time and stops after a certain period of time. Thus, the circulation heater 17 needs to be repetitively driven to generate heat in order to generate a steady circulatory flow F for a certain period of time. The periodic intervals at which to drive the circulation heater 17 only need to be such that the concentrated ink in the ejection orifice 11 is discharged, and are not particularly limited. For example, the circulation heater 17 is driven at periodic intervals of about 100 Hz to 10 kHz. Generally, the higher the driving frequency, the higher the concentrated ink discharging effect. However, it is necessary to appropriately drive the circulation heater 17 by taking into account the rise in ink temperature by the heat generated by the circulation heater 17 while it is driven.

Figure 3:
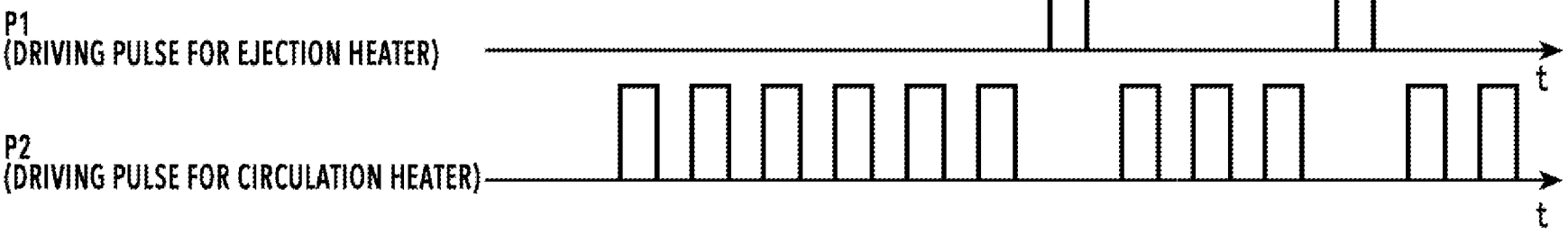
FIG. 3 is an explanatory diagram of driving pulses for an ejection heater and a circulation heater in FIGS. 1A to 1C.

FIG. 3 is an explanatory diagram of timings to drive the ejection heater 16 and the circulation heater 17 in the present embodiment.

In the present embodiment, driving pulses P1 and P2 of a particular pulse width are applied to the ejection heater 16 and the circulation heater 17, respectively. The ejection heater 16 is driven to eject ink based on the driving pulses P1, which correspond to print data. The circulation heater 17 is driven such that the variation in ink pressure caused by the driving of the circulation heater 17 does not affect the ink ejection operation. For example, the circulation heater 17 is driven in periods other than the periods in which the ejection heater 16 is driven and the periods of a certain length of time before and after the driving periods. In a case where small-sized circulation heaters 17 are densely arranged, the speed of each circulatory flow F is low and thus the circulatory flow F attenuates more easily with the elapse of time. In this case, in order to generate a steady circulatory flow F for a particular period of time, the driving frequency for the circulation heater 17 needs to be high, which makes the rise in ink temperature accordingly greater. A configuration of the channel 13 as shown in FIG. 1B is effective in suppressing such a rise in ink temperature. Specifically, the configuration enables the heaters 16 and 17 to be densely arranged without interfering with each other and enables the circulation heaters 17 to be densely arranged while avoiding reduction in their size. These advantages of the configuration of the channel 13 are also clear from a comparison with the U-shaped channel configuration described below as a comparative example.

Figure 4A:
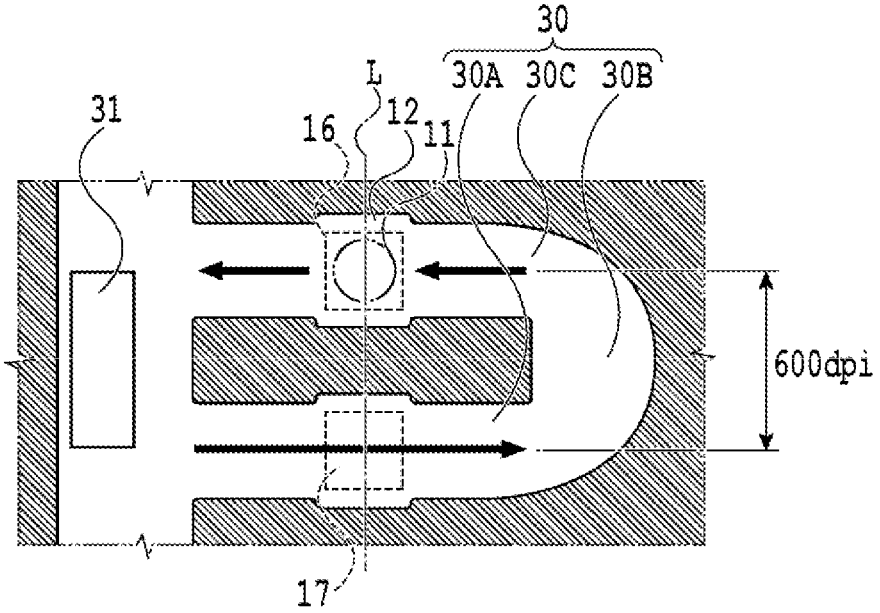
FIGS. 4A and 4B are explanatory diagrams of a liquid ejection head as a comparative example.
Figure 4B:
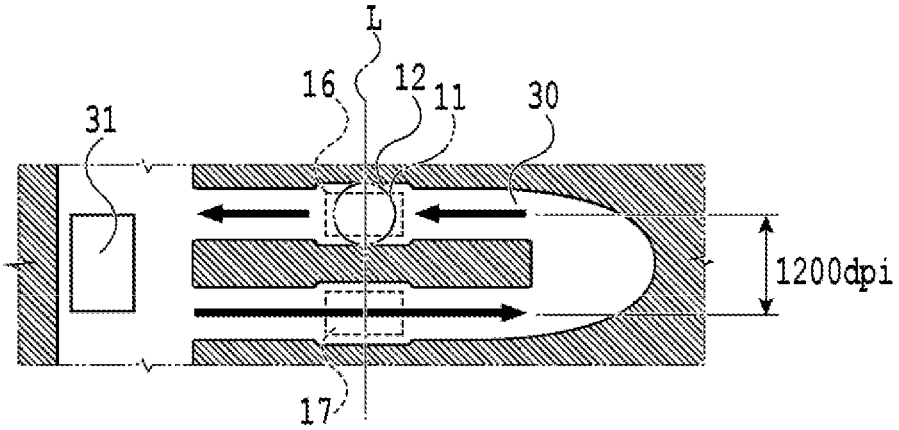

FIGS. 4A and 4B are explanatory diagrams of the configuration of a U-shaped channel 30 as the comparative example. As shown in FIG. 4A, the channel 30 includes: a channel portion 30A in which an ink flow from the left side toward the right side of the ejection orifice array L is formed; a channel portion 30B in which the direction of the ink flow is shifted toward the upper side in FIG. 4A; and a channel portion 30C in which an ink flow from the right side toward the left side of the ejection orifice array L is formed. The pressure chamber 12 and the ejection heater 16 are located in the channel portion 30C, and the circulation heater 17 is arranged in the channel portion 30A to be located on the ejection orifice array L. The channel portions 30A and 30C communicate with a common supply channel 31 on the left side of the ejection orifice array L, and ink externally supplied into the supply channel 31 is circulated through the channel 30 as shown by the arrows.

In the configuration of this U-shaped channel 30, the straight channel portions 30A and 30C are present on the ejection orifice array L, and the ejection orifices 11 and the circulation heaters 17 are located alternately in the direction in which the ejection orifice array L extends. The channel 30 in FIG. 4A represents an example configuration in a case where the print resolution in the direction of the ejection orifice array L is 300 dpi and the pitch between the ejection orifice 11 and the circulation heater 17 is a length corresponding to 600 dpi. The channel 30 in FIG. 4B represents an example configuration in a case where the print resolution in the direction of the ejection orifice array L is 600 dpi and the pitch between the ejection orifice 11 and the circulation heater 17 is a length corresponding to 1200 dpi. Assume for example a case where a pitch P between the ejection orifices 11 in the configuration of FIG. 1B is a length corresponding to a print resolution of 600 dpi and the heaters 16 and 17 in FIGS. 1B and 4A have the same size. In this case, with the configuration of FIG. 4A, the print resolution in the direction of the ejection orifice array L is a half, which is 300 dpi. Moreover, the size of the heaters 16 and 17 needs to be small as shown in FIG. 4B in order to achieve a print resolution of 600 dpi as in FIG. 1B with the configuration of the U-shaped channel 30. Such a decrease in size of the circulation heater 17 and an increase in flow resistance due to narrowing of the channel 30 make the speed of the ink circulatory flow low, which in turn makes thickened ink more prone to remain in the ejection orifice 11.

Other Embodiments

Figure 5A:
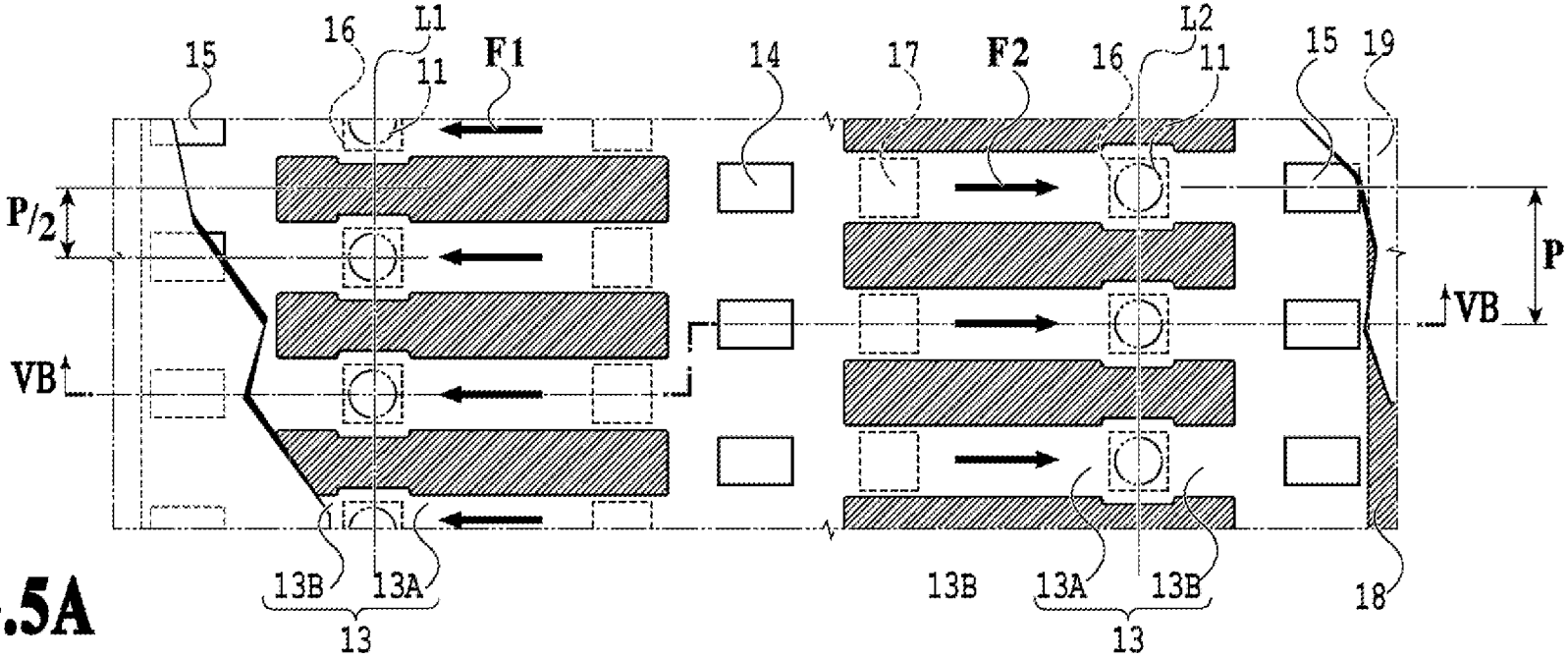
FIGS. 5A and 5B are explanatory diagrams of a liquid ejection head in another embodiment of the present disclosure.
Figure 5B:
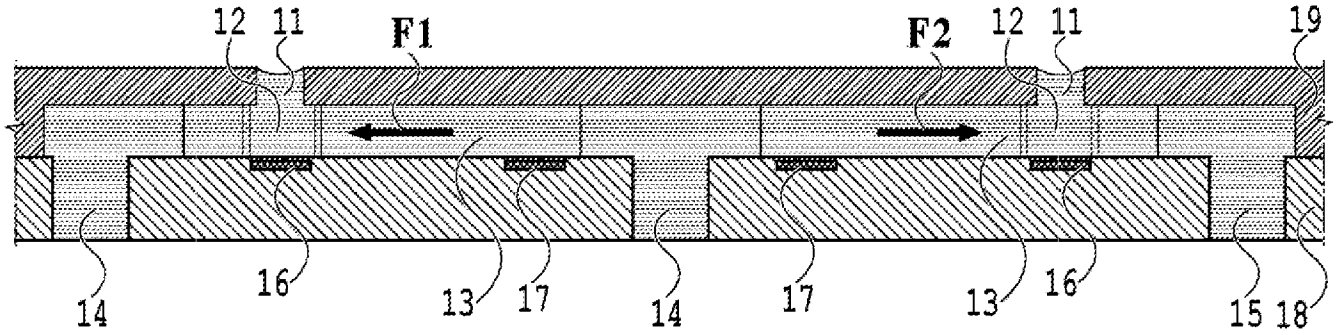
Figure 6A:
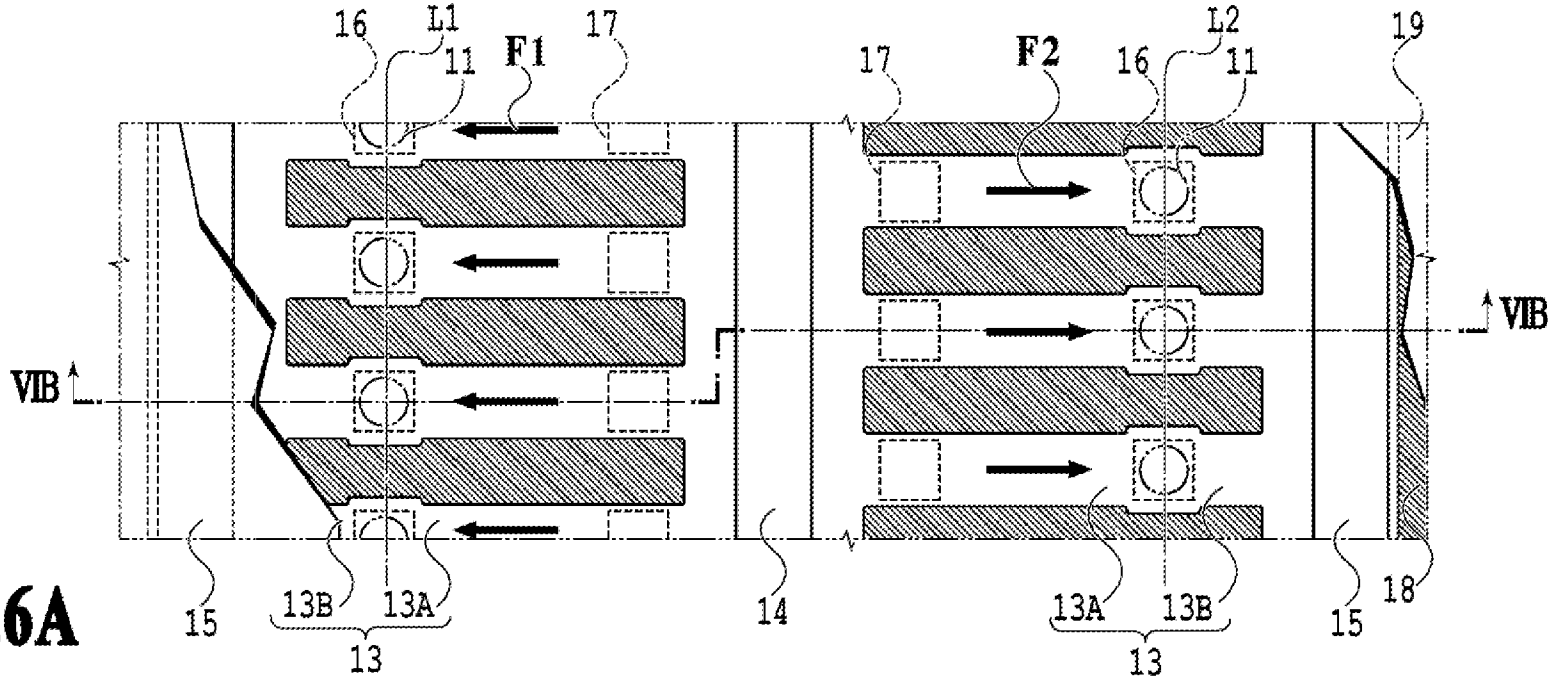
FIGS. 6A and 6B are explanatory diagrams of a liquid ejection head in still another embodiment of the present disclosure.
Figure 6B:
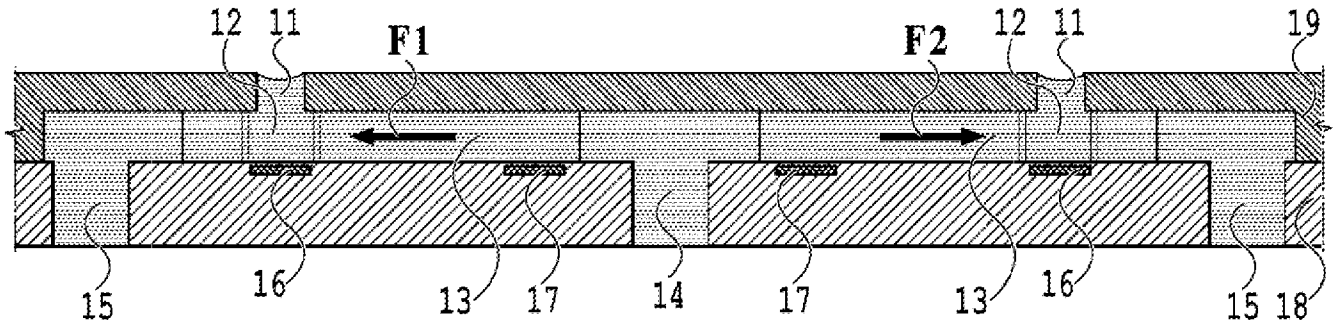
Figure 7A:
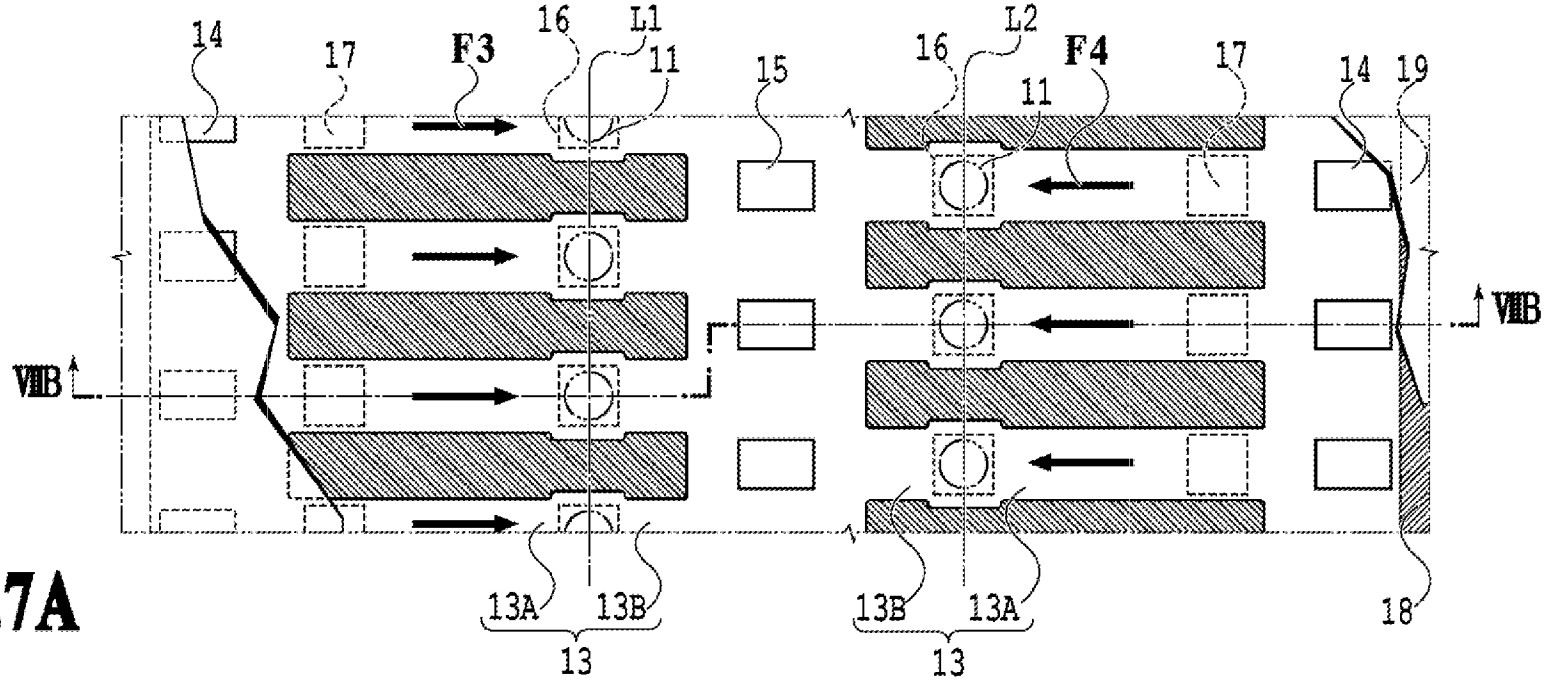
FIGS. 7A and 7B are explanatory diagrams of a liquid ejection head in yet another embodiment of the present disclosure.
Figure 7B:
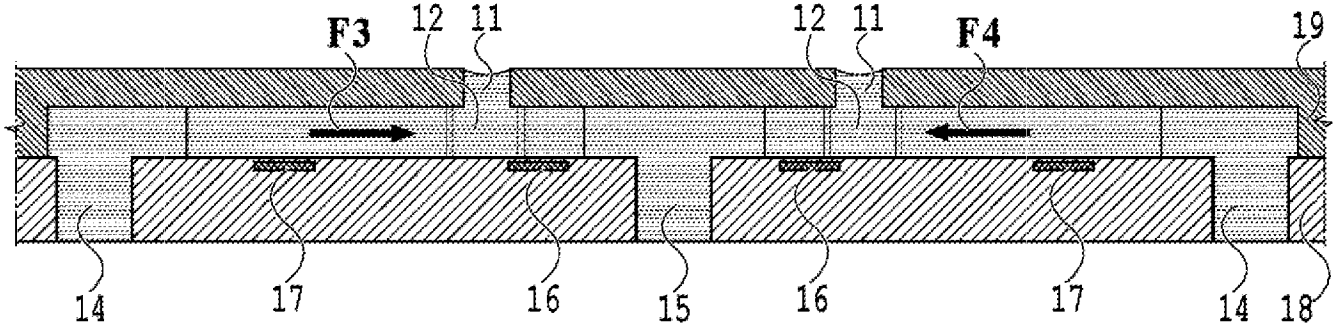

FIGS. 5 to 7 are explanatory diagrams of channel configurations in other different embodiments of the present disclosure. FIGS. 5A, 6A, and 7A are cross-sectional views corresponding to FIG. 1B. FIG. 5B is a cross-sectional view along line VB-VB in FIG. 5A. FIG. 6B is a cross-sectional view along line VIB-VIB in FIG. 6A. FIG. 7B is a cross-sectional view along line VIIB-VIIB in FIG. 7A.

In the embodiment of FIGS. 5A and 5B, the positions of ejection orifices 11 in two ejection orifice arrays L1 and L2 are offset from each other by a half pitch (P/2), and channels 13 are formed for these ejection orifice arrays L1 and L2 so as to generate ink circulatory flows F1 and F2 in mutually opposite directions. Thus, the positional relation between the heaters 16 and 17 in the channels 13 for the ejection orifice array L1 and the positional relation between the heaters 16 and 17 in the channels 13 for the ejection orifice array L2 are the reverse of each other in the left-right direction in FIG. 5B. Supply channels 14 are formed between the ejection orifice arrays L1 and L2 so as to communicate as common supply channels with first channels 13A in the channels 13 for the ejection orifice arrays L1 and L2. Outlet channels 15 are formed on the outer sides (the left and right sides in FIG. 5A) of the ejection orifice arrays L1 and L2 for individual second channels 13B in the channels 13 for the ejection orifice arrays L1 and L2. In this way, the same ink is ejected from the two ejection orifice arrays L1 and L2. As a result, large circulatory flows F1 and F2 are generated while also a high resolution corresponding to the pitch P/2 is achieved.

The embodiment of FIGS. 6A and 6B is implemented by changing the shape of the outlet channels 15 for the individual second channels 13B in the embodiment of FIGS. 5A and 5B into the shape of an elongated hole extending along the direction of the ejection orifice array. In this manner, an outlet channel 15 in the elongated hole shape is shared by the plurality of second channels 13B. The supply channels 14 are likewise changed into the shape of an elongated hole.

The embodiment of FIGS. 7A and 7B is implemented by forming channels for ejection orifice arrays L1 and L2 such that circulatory flows F3 and F4 are generated in directions opposite from the directions of the circulatory flows F1 and F2 in the embodiment of FIGS. 5A and 5B. Outlet channels 15 are formed between the ejection orifice arrays L1 and L2 so as to communicate as common outlet channels with second channels 13B in channels 13 for the ejection orifice arrays L1 and L2. Supply channels 14 are formed on the outer sides (the left and right sides in FIG. 7A) of the ejection orifice arrays L1 and L2 for individual first channels 13A in the channels 13 for the ejection orifice arrays L1 and L2.

In the above embodiments, all of the plurality of channels corresponding to the plurality of ejection orifices forming the ejection orifice arrays are configured as the channel 13. However, at least one of the plurality of channels may be configured as the channel 13. Also, in the above embodiments, the sizes of the ejection orifices forming the different ejection orifice arrays are the same. However, the sizes of the ejection orifices forming the different ejection orifice arrays may be varied from each other to thereby vary their ink ejection amounts from each other.

Example Configuration of Inkjet Printing Apparatus

Figure 8A:
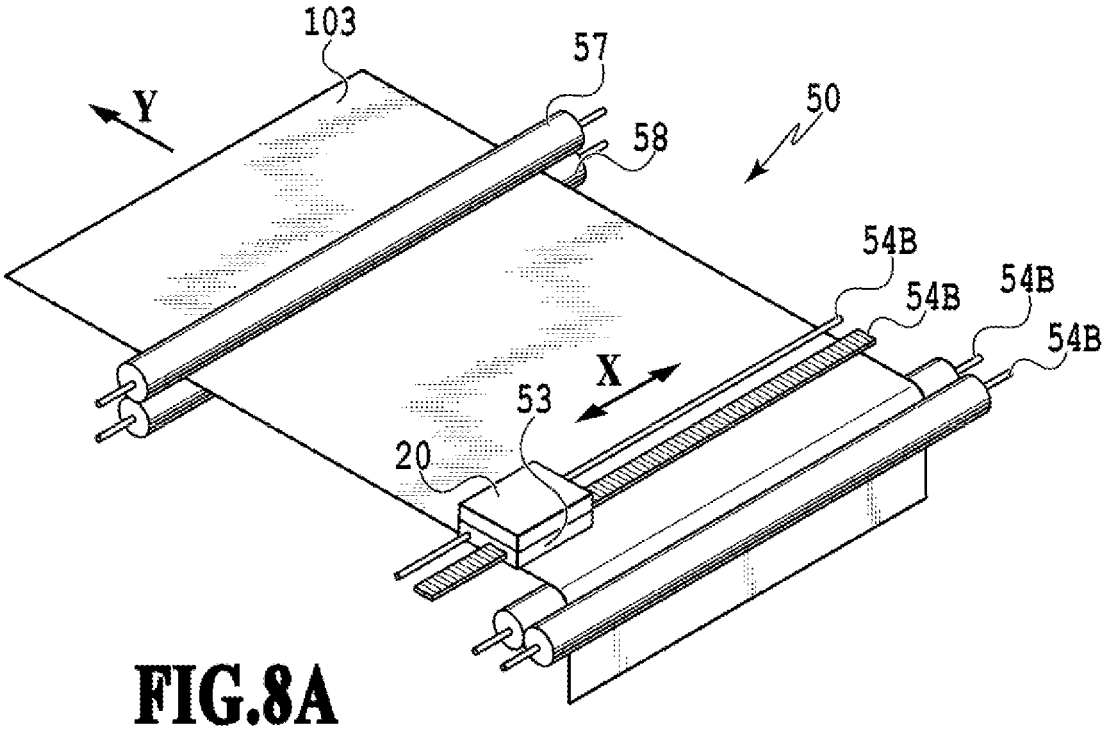
FIGS. 8A and 8B are explanatory diagrams of an example configuration of a liquid ejection apparatus of the present disclosure.

The print head (liquid ejection head) 20 in each of the above embodiments can be used in various inkjet printing apparatuses (liquid ejection apparatuses) such as so-called serial scan-type and full line-type inkjet printing apparatuses. FIG. 8A is an example configuration of a serial scan-type inkjet printing apparatus in which the print head 20 in one of the above embodiments is detachably mounted on a carriage 53 that moves in the direction of arrow X in FIG. 8A (main scanning direction). The carriage 53 is guided by guide members 54A and 54B, and a print medium P is conveyed by rolls 55, 56, 57, and 58 in the direction of arrow Y (sub scanning direction). An image is printed onto the print medium P by repeating an operation of ejecting ink from the print head 20 while moving the print head 20 in the main scanning direction with the carriage 53 and an operation of conveying the print medium P in the sub scanning direction.

Figure 8B:
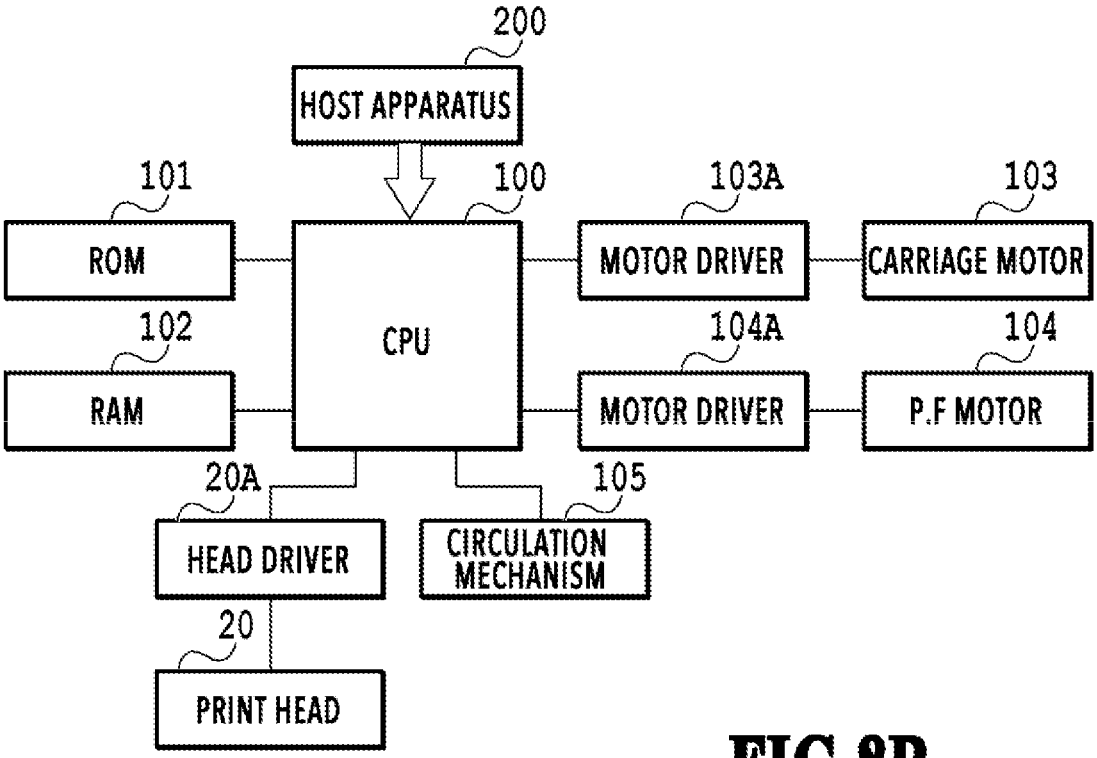

FIG. 8B is a block diagram of a control system in the inkjet printing apparatus in FIG. 8A. A CPU (control unit) 100 executes processing of controlling the operation of the printing apparatus, data processing, and so on. A ROM 101 stores programs for procedures for these types of processing and so on, and a RAM 102 is used as a work area or the like for executing these types of processing. The heaters 16 in the print head 20 are driven via a head driver 20A. The printing of an image is performed by supplying driving data for the heaters 16 (image data) and driving control signals (heat pulse signals) to the head driver 20A. The CPU 100 controls a carriage motor 103 for driving the carriage 53 in the main scanning direction via a motor driver 103A, and controls a PF motor 104 for conveying the print medium P in the sub scanning direction via a motor driver 104A. The CPU 100 also controls a circulation mechanism 105 including micropumps or the like to cause ink to flow in the channels 13 through the pressure chambers 12, as described earlier.

The present disclosure is not limited only to inkjet print heads and inkjet printing apparatuses as described in the above embodiments, but is widely applicable as liquid ejection heads, liquid ejection apparatuses, and liquid ejection methods capable of ejecting various liquids. The liquid ejection head, the liquid ejection apparatus, and the liquid supply method of the present disclosure are applicable to apparatuses such as printers, copying machines, facsimile machines with a communication system, and word processors with a printer unit, and further to industrial printing apparatuses integrally combined with various processing apparatuses. The present disclosure can be used in applications such as fabrication of a biochip and printing of an electronic circuit.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-242989 filed Dec. 26, 2018, which is hereby incorporated by reference herein in its entirety.

What is claimed is:

1. A liquid ejection head comprising:

a plurality of ejection orifices forming a first ejection orifice array and a second ejection orifice array;

a plurality of pressure chambers corresponding to the plurality of ejection orifices;

a plurality of ejection energy generation elements configured to eject a liquid in the plurality of pressure chambers from the plurality of ejection orifices corresponding to the plurality of pressure chambers;

a plurality of channels in which the liquid is caused to flow through the plurality of pressure chambers; and a plurality of flow energy generation elements configured to cause the liquid in the plurality of channels to flow, wherein the plurality of channels include a plurality of first channels in which the liquid is caused to flow through the plurality of pressure chambers corresponding to the plurality of ejection orifices forming the first ejection orifice array, and a plurality of second channels in which the liquid is caused to flow through the plurality of pressure chambers corresponding to the plurality of ejection orifices forming the second ejection orifice array, at least one of the plurality of first channels extends in a direction crossing the first ejection orifice array such that the liquid flows between two ends of the at least one first channel located on sides of the first ejection orifice array, at least one of the plurality of second channels extends in a direction crossing the second ejection orifice array such that the liquid flows between two ends of the at least one second channel located on sides of the second ejection orifice array, the plurality of ejection orifices forming the first ejection orifice array and the second ejection orifice array are arrayed at a predetermined pitch, and the ejection orifices in the first ejection orifice array and the ejection orifices in the second ejection orifice array are offset from each other by a half of the predetermined pitch.

2. The liquid ejection head according to claim 1, wherein a first flow resistance between one of the two ends of each of the channels and the corresponding flow energy generation element and a second flow resistance between the other of the two ends of the channel and the corresponding flow energy generation element are different from each other.

3. The liquid ejection head according to claim 1, wherein the ends of the first channels and the ends of the second channels located between the first ejection orifice array and the second ejection orifice array communicate with a common supply channel or a common outlet channel.

4. The liquid ejection head according to claim 1, wherein the ejection orifices in the first ejection orifice array and the ejection orifices in the second ejection orifice array differ from each other in size.

5. The liquid ejection head according to claim 1, wherein each of the flow energy generation elements comprises an electrothermal conversion element and is located closer to one of the two ends than the corresponding ejection energy generation element is.

6. The liquid ejection head according to claim 1, wherein each of the flow energy generation elements comprises an electrothermal conversion element.

7. The liquid ejection head according to claim 1, wherein each of the ejection energy generation elements comprises an electrothermal conversion element.

8. A liquid ejection head comprising:

a plurality of ejection orifices forming an ejection orifice array;

a plurality of pressure chambers corresponding to the plurality of ejection orifices;

a plurality of ejection energy generation elements configured to eject a liquid in the plurality of pressure chambers from the plurality of ejection orifices corresponding to the plurality of pressure chambers;

a plurality of channels in which the liquid is caused to flow through the plurality of pressure chambers; and a plurality of flow energy generation elements configured to cause the liquid in the plurality of channels to flow, wherein at least one of the plurality of channels extends in a direction crossing the ejection orifice array such that the liquid flows between two ends of the channel located on sides of the ejection orifice array, a first flow resistance between one of the two ends of the at least one channel and the corresponding flow energy generation element and a second flow resistance between the other of the two ends of the channel and the flow energy generation element are different from each other, and each of the flow energy generation elements comprises an electrothermal conversion element, and a ratio of the first flow resistance to the second flow resistance is 0.05 to 0.40.

9. A liquid ejection apparatus comprising:

a plurality of ejection orifices forming a first ejection orifice array and a second ejection orifice array, a plurality of pressure chambers corresponding to the plurality of ejection orifices, a plurality of ejection energy generation elements configured to eject a liquid in the plurality of pressure chambers from the plurality of ejection orifices corresponding to the plurality of pressure chambers, a plurality of channels in which the liquid is caused to flow through the plurality of pressure chambers, and a plurality of flow energy generation elements configured to cause the liquid in the plurality of channels to flow, at least one of the plurality of channels extending in a direction crossing the ejection orifice array such that the liquid flows between two ends of the at least one channel located on sides of the ejection orifice array;

a supply unit configured to supply the liquid into the channels of the liquid ejection head; and a control unit configured to control the ejection energy generation elements and the flow energy generation elements, wherein the plurality of channels include a plurality of first channels in which the liquid is caused to flow through the plurality of pressure chambers corresponding to the plurality of ejection orifices forming the first ejection orifice array, and a plurality of second channels in which the liquid is caused to flow through the plurality of pressure chambers corresponding to the plurality of ejection orifices forming the second ejection orifice array, at least one of the plurality of first channels extends in a direction crossing the first ejection orifice array such that the liquid flows between two ends of the at least one first channel located on sides of the first ejection orifice array, at least one of the plurality of second channels extends in a direction crossing the second ejection orifice array such that the liquid flows between two ends of the at least one second channel located on sides of the second ejection orifice array, the plurality of ejection orifices forming the first ejection orifice array and the second ejection orifice array are arrayed at a predetermined pitch, and the ejection orifices in the first ejection orifice array and the ejection orifices in the second ejection orifice array are offset from each other by a half of the predetermined pitch.

10. The liquid ejection apparatus according to claim 9, wherein a first flow resistance between one of the two ends of each of the channels and the corresponding flow energy generation element and a second flow resistance between the other of the two ends of the channel and the corresponding flow energy generation element are different from each other.

11. The liquid ejection apparatus according to claim 9, wherein the ends of the first channels and the ends of the second channels located between the first ejection orifice array and the second ejection orifice array communicate with a common supply channel or a common outlet channel.

12. The liquid ejection apparatus according to claim 9, wherein the ejection orifices in the first ejection orifice array and the ejection orifices in the second ejection orifice array differ from each other in size.

* * * * *